United States Patent [19]

Camardella

[11] 4,301,975

[45] Nov. 24, 1981

[54] DEVICE FOR SUPPLYING A PAIR OF WIRES TO A ROTATING WIRE GUIDE IN A COIL WINDING MACHINE

[75] Inventor: Giuseppe Camardella, Saronno, Italy

[73] Assignee: Tekma Kinomat S.p.A, Caronno Pertusella, Italy

[21] Appl. No.: 95,939

[22] Filed: Nov. 20, 1979

[30] Foreign Application Priority Data

Nov. 24, 1978 [IT] Italy ..... 30142 A/78

[51] Int. Cl.[3] ..... B65H 54/00

[52] U.S. Cl. ..... 242/25 R; 57/18; 57/58.3; 242/7.11; 242/7.14; 242/42; 242/47

[58] Field of Search ..... 242/25 R, 42, 47, 53, 242/1, 7.11, 7.14, 18 R; 57/58.3, 58.36, 58.38, 3, 18

[56] References Cited

U.S. PATENT DOCUMENTS 4,197,696 4/1980 Bock ..... 57/58.3 X 4,204,392 5/1980 Bock ..... 57/18

*Primary Examiner*—Stanley N. Gilreath

*Attorney, Agent, or Firm*—Young & Thompson

[57] ABSTRACT

A device for supplying two separate wires to a wire guide in a coil winding machine of the kind comprising a stationary coil support, a rotating wire guide and two spools for supplying said wires. A first stationary spool is mounted on a support at least partly disposed coaxially to the wire guide axis and the first wire unwound therefrom is guided along said axis, means being provided for guiding the second wire—unwound from the second spool, disposed upstream of the first spool—along a path which runs astride of the first spool and is rotated around it in time with the rotation of the wire guide.

4 Claims, 1 Drawing Figure

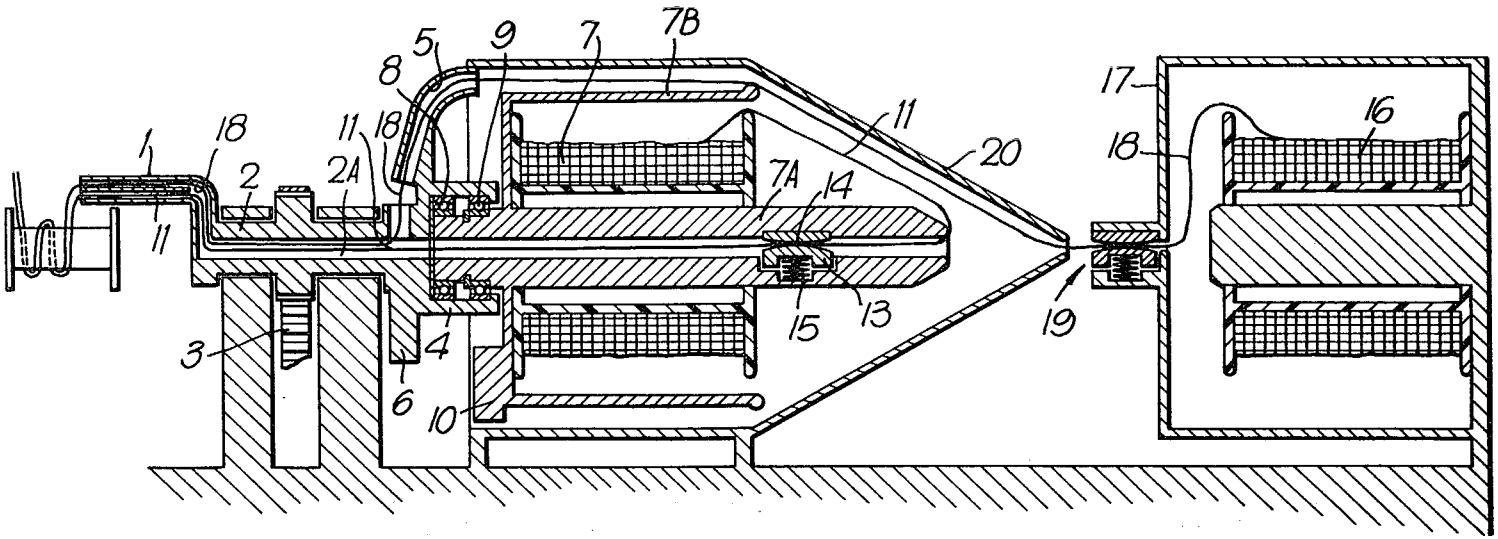
16
17
18
19
20
11
13
14
15
7A
7B
7
9
5
8
18
11
2A
2
18
1
11
4
6
10
3

DEVICE FOR SUPPLYING A PAIR OF WIRES TO A ROTATING WIRE GUIDE IN A COIL WINDING MACHINE

BACKGROUND OF THE INVENTION

1. Field of the Invention

The invention relates to a device for supplying a "pair of wires", i.e. two separate wires which are side by side but not interlaced, to the wire guide of a coil winding machine, more particularly a rotary wire guide.

In the art of manufacturing coils of copper wire, there is a known problem of winding the pair of wires when the winding machine is of the kind having a fixed coil and a wire guide rotating around it. In such cases it is essential to prevent interlacing of the two wires which form the pair and come from two separate supply spools.

2. Description of the Prior Art

This problem has hitherto been solved by various devices, but in nearly all cases the supply spools are mounted on a holder which rotates in time with the wire guide. It can easily be seen, however, that this method is relatively complex, inefficient and disadvantageous, mainly because of the difficulty of subjecting the rotary group of spools (which has high inertia and momentum) to the high rotation speed and abrupt accelerations to which the wire guide is normally subjected.

More recently, it has been proposed to place a first spool so that it rotates in time with the wire guide, whereas the second spool is held stationary. This method, which reduces the inertia of the rotary group of spools, clearly improves the operating conditions but the improvement is still inadequate, more particularly with regard to the supply of wire guides rotating at higher speeds.

SUMMARY OF THE INVENTION

The object of the present invention is to provide a radical solution to this problem enabling both spools to be disposed in a fixed position and the respective wires to be unwound.

This is achieved, according to the invention, by providing, in a coil winding machine having a rotary wire guide and two supply spools for supplying two separate wires to the wire guide, a first stationary spool mounted on a support at least partly disposed coaxially to the wire guide axis, the wire unwound therefrom being guided along said axis, and means for guiding the wire—unwound from the second stationary spool, disposed upstream of the first spool—along a path which runs astride of the first spool and is rotated around it in time with the rotation of the wire guide.

More particularly, the wire guide shaft is provided, at the end remote from the wire guide itself, with a seat bearing the support of the first spool, said seat being rotatable with the wire guide and in it being mounted freely rotatable the stationary support of the first spool, and with a duct guiding the wire coming from the second spool at least partly along said path which runs astride of the first spool, this path being rotated along a surface of revolution surrounding the first spool and having the same axis as the wire guide shaft.

According to an important feature of the invention, the support of the first spool is held fixed, relative to its rotary supporting seat, by retaining means which do not have direct contact with the stationary parts of the machine and can comprise, for example, a system of counterweights or a magnetic field system.

DESCRIPTION OF THE PREFERRED EMBODIMENT

Other characteristics and advantages of the device according to the invention will be clear from the following description with reference to the single accompanying drawing, which shows a preferred embodiment in a very diagrammatic axial section.

The drawing shows the shaft 2 of a wire guide 1 driven in rotation by a belt 3. At the end remote from the wire guide 1, the shaft 2 carries a seat 4, holding a support for a first supply spool (described in greater detail hereinafter), and a duct 5 for guiding the wire coming from a second spool.

The duct 5, which extends in the radial direction, is balanced by a counter-weight 6, and the wire guide 1 is similarly balanced in known manner, so that shaft 2 rotates in complete equilibrium and without vibrations even at high speeds.

The end of a shaft 7A is rotatably mounted in the seat 4 and, together with a cage 7B, constitutes the support holding the first spool 7. This mounting is obtained by means of a pair of bearings 8 and 9 which are specially designed to reduce friction between the two parts in relative rotation. When the wire guide shaft 2 rotates, the support 7A–7B holding the spool 7 remains stationary, owing to the presence of a single mass or eccentric counter-weight 10 which determines a stable equilibrium position of the support. This eccentric mass can merely be obtained by mounting the spool in an eccentric position in respect of the axis of the seat 4.

The counter-weight system 10 may be replaced by a magnetic field system comprising e.g. a ferromagnetic mass secured to cage 7B (which of course will be made of non-ferromagnetic material) and a magnet in a fixed position, between which there can be a sufficiently wide air gap, for a purpose specified hereinafter.

The shaft 7A has an axial bore so that the wire 11, which unwinds from the spool 7, is guided in the axial bore and subsequently into the axial duct 2A of the wire guide shaft. Means for braking the wire, e.g. a pair of clamping shoes 13, 14 and a pressure spring 15, can be disposed along the axial bore in shaft 7A.

The second spool 16 is in turn mounted on a stationary holder and enclosed in a protective chamber 17. The chamber can be directly associated with means 19 for braking the wire 18, identical to the braking means 13, 14, 15, associated to shaft 7A.

As shown, the wire 18 leaving the spool 16 is guided towards duct 5 along a path which runs astride or passes over cage 7B, so as not to interfere with the unwinding of wire 11 from spool 7. After leaving duct 5, wire 18 travels through the axial duct 2A of the wire guide shaft, alongside wire 11. It is clear from the preceding description that the two wires are freely unwound from the respective spools without becoming twisted together. More particularly, the rotation of duct 5 causes the path of wire 18 to rotate around and astride of the cage 7B surrounding the cage along a surface of revolution which is coaxial with the wire guide shaft 2 and completely surrounding the space occupied by the support bearing the first spool.

In order to ensure that the wire 18 is not unwound more than necessary by centrifugal force, particularly when it rotates at high speed, in the path running astride of the cage 7B, usually between the outlet of the braking means 19 and the inlet of duct 5, the path is protected by a suitably shaped protective and guide wall 20.

During its rotation, wire 18 travels therefore in the narrow space between the cage 7B and the wall 20, more particularly between the counter-weight 10 and the wall 20 or,—according to the aforementioned different embodiment comprising a magnetic-field retaining system—in the air gap between the ferromagnetic mass and the stationary magnet.

The preceding description of an embodiment of the invention is by way of example only and can have numerous variants, more particularly with regard to the means for keeping stationary the first spool support, which may be different from a counter-weight or a magnetic system, without thereby departing from the protection scope of the present invention.

I claim:

1. A machine for winding two parallel wires in untwisted relation onto a stationary coil core, comprising a wire guide shaft having an axial bore for guiding the two wires, means for rotating said shaft about its axis, a wire guide carried by said wire guide shaft and having two parallel guiding bores, one for each of said two wires, that are spaced a substantial distance from said axis, a shaft on which is supported a first spool for feeding a first of said two wires, said shaft having an axial bore therethrough which is coaxial with and communicates with said bore of said wire guide shaft, means mounting said shaft for the support of said first spool freely rotatably on said wire guide shaft, means for maintaining said shaft for the support of said first spool stationary while said wire guide shaft rotates, an arcuate guide duct secured to said wire guide shaft, said duct extending radially away from said axis and then curving over into an inlet end that extends parallel to said axis, and a second stationary spool for feeding the second of said two wires, means for feeding wire from said second spool radially outwardly of said first spool and into said inlet end of said arcuate guide duct, and means for braking each of said wires.

2. A machine as claimed in claim 1, said braking means comprising a brake for said first wire disposed in said axial bore of said shaft for the support of said first spool, and a brake for said second wire disposed on the axis of said second spool.

3. A machine as claimed in claim 2, and a stationary housing for said second spool, the last-named brake being disposed on said stationary housing.

4. A machine as claimed in claim 1, in which said axis is horizontal and said means for keeping the shaft for supporting the first spool stationary comprising an eccentric counterweight carried by the last-named shaft.

* * * * *